US006116031A

United States Patent [19]

Minta et al.

[11] Patent Number: 6,116,031

[45] Date of Patent: Sep. 12, 2000

[54] PRODUCING POWER FROM LIQUEFIED NATURAL GAS

[75] Inventors: Moses Minta, Sugar Land; Ronald R. Bowen, Magnolia, both of Tex.

[73] Assignee: ExxonMobil Upstream Research Company, Houston, Tex.

[21] Appl. No.: 09/277,071

[22] Filed: Mar. 26, 1999

Related U.S. Application Data

[60] Provisional application No. 60/079,642, Mar. 27, 1998.

[51] Int. Cl.[7] ..... F17C 9/02

[52] U.S. Cl. ..... 62/50.2

[58] Field of Search ..... 62/50.2, 614

[56] References Cited

U.S. PATENT DOCUMENTS

| | | | |
|---|---|---|---|
| 2,975,607 | 3/1961 | Bodle | 62/52 |
| 3,068,659 | 12/1962 | Marshall, Jr. | 62/52 |
| 3,183,666 | 5/1965 | Jackson | 60/38 |
| 3,203,191 | 8/1965 | French | 62/9 |
| 3,405,530 | 10/1968 | Denahan et al. | 62/28 |
| 3,425,548 | 2/1969 | Pitaro | 62/53 |
| 3,479,832 | 11/1969 | Sarsten et al. | 62/52 |
| 3,978,663 | 9/1976 | Mandrin et al. | 60/39.67 |
| 3,992,891 | 11/1976 | Pocrnja | 62/53 |
| 4,030,301 | 6/1977 | Anderson | 60/641 |
| 4,320,303 | 3/1982 | Ooka et al. | 290/1 R |
| 4,400,947 | 8/1983 | Ruhemann | 60/648 |
| 4,429,536 | 2/1984 | Nozawa | 60/655 |
| 4,437,312 | 3/1984 | Newton et al. | 60/648 |
| 4,444,015 | 4/1984 | Matsumoto et al. | 60/648 |
| 4,479,350 | 10/1984 | Newton et al. | 60/655 |
| 5,440,588 | 8/1995 | Yamane et al. | 60/39.465 |
| 5,457,951 | 10/1995 | Johnson et al. | 60/39.02 |

OTHER PUBLICATIONS

L. L. Johnson and G. Renaudin, 'Liquid turbines' improve LNG Operations; Oil and Gas Journal, Nov. 1996, pp. 31–32 and 35–36.

H. Kashimura, et al., Power generator using cold potential of LNG in multicomponent fluid rankine cycle, Seventh International Conference on Liquefied Natural Gas, May 15–19, 1983, pp. 2–14.

S. H. Chansky and J. E. Haley, How to use the cold in LNG, The Magazine of Gas Distribution, Aug. 1968, pp. 42–47.

*Primary Examiner*—William Doerrler
*Assistant Examiner*—Malik N. Drake
*Attorney, Agent, or Firm*—Gary D. Lawson

[57] ABSTRACT

A process is disclosed for converting liquefied natural gas (LNG), at a temperature of about −162° C. (−260° F.) and a pressure near atmospheric pressure, to a pressurized liquefied natural gas (PLNG) having a temperature above −112° C. (−170° F.) and a pressure sufficient for the liquid to be at or near its bubble point and at the same time producing energy derived from the cold of the LNG. The LNG is pumped to a pressure above 1,380 kPa (200 psia) and passed through a heat exchanger. A refrigerant as a working fluid in a closed circuit is passed through the heat exchanger to condense the refrigerant and to provide heat for warming the pressurized LNG. The refrigerant is then pressurized, vaporized by an external heat source, and then passed through a work-producing device to generate energy.

7 Claims, 1 Drawing Sheet

Liquefied Natural Gas Phase Diagram

Liquefied Natural Gas Phase Diagram
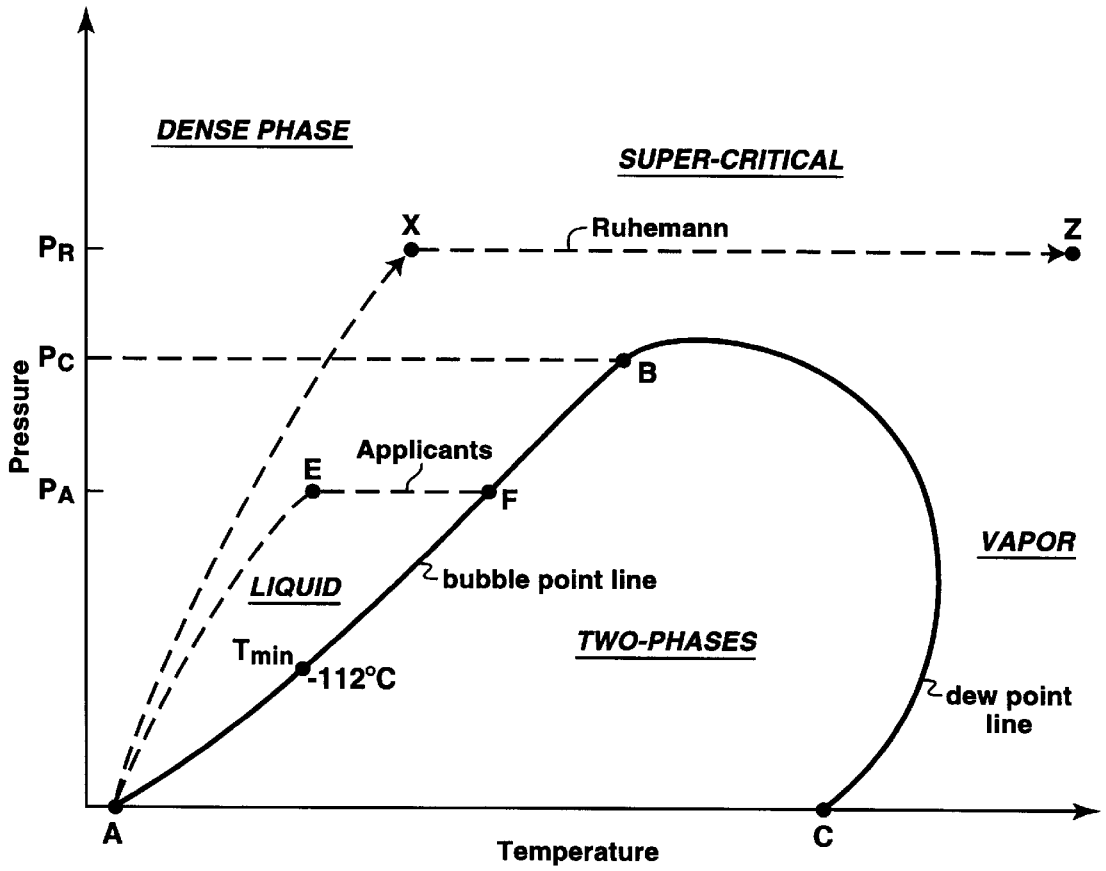

PRODUCING POWER FROM LIQUEFIED NATURAL GAS

This application claims the benefit of U.S. Provisional Application No. 60/079,642, filed Mar. 27, 1998.

FIELD OF THE INVENTION

This invention relates generally to a process for converting liquefied natural gas at one pressure to liquefied natural gas at a higher pressure and producing by-product power by economic use of the available liquefied natural gas cold sink.

BACKGROUND OF THE INVENTION

Natural gas is often available in areas remote to where it will be ultimately used. Quite often the source of this fuel is separated from the point of use by a large body of water and it may then prove necessary to transport the natural gas by large vessels designed for such transport. Natural gas is normally transported overseas as cold liquid in carrier vessels. At the receiving terminal, this cold liquid, which in conventional practice is at near atmospheric pressure and at a temperature of about −160° C.(−256° F.) must be regasified and fed to a distribution system at ambient temperature and at a suitable elevated pressure, generally around 80 atmospheres. This requires the addition of a substantial amount of heat and a process for handling LNG vapors produced during the unloading process. These vapors are sometimes referred to as boil-off gases.

Many suggestions have also been made and some installations have been built to use the large cold potential of the LNG. Some of these processes use the LNG vaporization process to produce by-product power as a way of using the available LNG cold. The available cold is used by using as a hot sink energy sources such as seawater, ambient air, low-pressure steam and flue gas. The heat-transfer between the sinks is effected by using a single component or multi-component heat-transfer medium as the heat exchange media. For example, U.S. Pat. No. 4,320,303 uses propane as a heat-transfer medium in a closed loop process to generate electricity. The LNG liquid is vaporized by liquefying propane, the liquid propane is then vaporized by seawater, and the vaporized propane is used to power a turbine which drives an electric power generator. The vaporized propane discharged from the turbine then warms the LNG, causing the LNG to vaporize and the propane to liquefy. The principle of power generation from LNG cold potential is based on the Rankine cycle, which is similar to the principle of the conventional thermal power plants.

Before the practice of this invention, all proposals for using the cold potential of LNG involved regasification of the LNG. The prior art did not recognize the benefits of converting liquefied natural gas at one pressure to liquefied natural gas at a higher temperature and using the cold potential of the lower pressure LNG.

SUMMARY

The practice of this invention provides a source of power to meet the compression horsepower needed to convert conventional LNG to pressurized LNG.

In the process of this invention, liquefied natural gas is pumped from a pressure at or near atmospheric pressure to a pressure above 1379 kPa (200 psia). The pressurized liquefied natural gas is then passed through a first heat exchanger whereby the pressurized liquefied natural gas is heated to a temperature above −112° C. (−170° F.) while keeping the liquefied natural gas at or below its bubble point. The process of this invention simultaneously produces energy by circulating in a closed power cycle through the first and second heat exchanger a first heat-exchange medium, comprising the steps of (1) passing to the first heat exchanger the first heat-exchange medium in heat exchange with the liquefied gas to at least partially liquefy the first heat-exchange medium; (2) pressurizing the at least partially liquefied first heat-exchange medium by pumping; (3) passing the pressurized first heat-exchange medium of step (2) through the first heat exchange means to at least partially vaporize the liquefied first heat-exchange medium; (4) passing the first heat-exchange medium of step (3) to the second heat exchanger to further heat the first heat-exchange medium to produce a pressurized vapor; (4) passing the vaporized first heat-exchange medium of step (3) through an expansion device to expand the first heat-exchange medium vapor to a lower pressure whereby energy is produced; (5) passing the expanded first heat-exchange medium of step (4) to the first heat exchanger; and (6) repeating steps (1) through (5).

BRIEF DESCRIPTION OF THE DRAWING

The present invention and its advantages will be better understood by referring to the following detailed description and the attached drawing which is a schematic flow diagram of one embodiment of this invention to convert LNG at one temperature and pressure to a higher temperature and pressure and recovering power as a by-product. The drawing is not intended to exclude from the scope of the invention other embodiments set out herein or which are the result of normal and expected modifications of the embodiment disclosed in the drawing.

DETAILED DESCRIPTION OF THE INVENTION

This process of this invention uses the cold of liquefied natural gas at or near atmospheric pressure to produce a liquefied natural gas product and to provide a power cycle that preferably provides power, part of which is preferably used for the process.

Referring to the drawing, reference character 10 designates a line for feeding liquefied natural gas (LNG) at or near atmospheric pressure and at a temperature of about −160° C.(−256° F.) to an insulated storage vessel 11. The storage vessel 11 can be an onshore stationary storage vessel or it can be a container on a ship. Line 10 may be a line used to load storage vessels on a ship or it can be a line extending from a container on the ship to an onshore storage vessel.

Although a portion of the LNG in vessel 11 will boil off as a vapor during storage and during unloading of storage containers, the major portion of the LNG in vessel 11 is fed through line 12 to a suitable pump 13. The pump 13 increases the pressure of the PLNG to the pressure above about 1,380 kPa (200 psia), and preferably above about 2,400 kPa (350 psia).

The liquefied natural gas discharged from the pump 13 is directed by line 14 through heat exchanger 15 to heat the LNG to a temperature above about −112° C. (−170° F.). The pressurized natural gas (PLNG) is then directed by line 16 to a suitable transportation or handling system.

A heat-transfer medium or refrigerant is circulated in a closed-loop cycle. The heat-transfer medium is passed from the first heat exchanger 15 by line 17 to a pump 18 in which the pressure of the heat-transfer medium is raised to an elevated pressure. The pressure of the cycle medium depends on the desired cycle properties and the type of medium used. From pump 18 the heat-transfer medium, which is in liquid condition and at elevated pressure, is passed through line 19 to heat exchanger 15 wherein the heat-transfer medium is heated. From the heat exchanger 15, the heat-transfer medium is passed by line 20 to heat exchanger 26 wherein the heat-transfer medium is further heated.

Heat from any suitable heat source is introduced to heat exchanger 26 by line 21 and the cooled heat source medium exits the heat exchanger through line 22. Any conventional low cost source of heat can be used; for example, ambient air, ground water, seawater, river water, or waste hot water or steam. The heat from the heat source passing through the heat exchanger 26 is transferred to the heat-transfer medium. This heat-transfer causes the gasification of the heat-transfer medium, so it leaves the heat exchanger 26 as a gas of elevated pressure. This gas is passed through line 23 to a suitable work-producing device 24. Device 24 is preferably a turbine, but it may be any other form of engine, which operates by expansion of the vaporized heat-transfer medium. The heat-transfer medium is reduced in pressure by passage through the work-producing device 24 and the resulting energy may be recovered in any desired form, such as rotation of a turbine which can be used to drive electrical generators or to drive pumps (such as pumps 13 and 18) used in the regasification process.

The reduced pressure heat-transfer medium is directed from the work-producing device 24 through line 25 to the first heat exchanger 15 wherein the heat-transfer medium is at least partially condensed, and preferably entirely condensed, and the LNG is heated by a transfer of beat from the heat-transfer medium to the LNG. The condensed heat-transfer medium is discharged from the heat exchanger 15 through line 17 to the pump 18, whereby the pressure of the condensed heat-transfer medium is substantially increased.

The heat-transfer medium may be any fluid having a freezing point below the boiling temperature of the pressurized liquefied natural gas, does not form solids in heat exchangers 15 and 26, and which in passage through heat exchangers 15 and 26 has a temperature above the freezing temperature of the heat source but below the actual temperature of the heat source. The heat-transfer medium may therefore be in liquid form during its circulation through heat exchangers 15 and 26 to provide a transfer of sensible heat alternately to and from the heat-transfer medium. It is preferred, however, that the heat-transfer medium be used which goes through at least partial phase changes during circulation through heat exchangers 15 and 26, with a resulting transfer of latent heat.

The preferred heat-transfer medium has a moderate vapor pressure at a temperature between the actual temperature of the heat source and the freezing temperature of the heat source to provide a vaporization of the heat-transfer medium during passage through heat exchangers 15 and 26. Also, the heat-transfer medium, in order to have a phase change, must be liquefiable at a temperature above the boiling temperature of the pressurized liquefied natural gas, such that the heat-transfer medium will be condensed during passage through heat exchanger 15. The heat-transfer medium can be a pure compound or a mixture of compounds of such composition that the heat-transfer medium will condense over a range of temperatures above the vaporizing temperature range of the liquefied natural gas.

Although commercial refrigerants may be used as heat-transfer mediums in the practice of this invention, hydrocarbons having 1 to 6 carbon atoms per molecule such as propane, ethane, and methane, and mixtures thereof, are preferred heat-transfer mediums, particularly since they are normally present in at least minor amounts in natural gas and therefore are readily available.

EXAMPLE

A simulated mass and energy balance was carried out to illustrate the preferred embodiment of the invention as described by the drawing, and the results are set forth in the Table below. The data in the Table assumed a LNG production rate of about 753 MMSCFD (37,520 kgmole/hr) and a heat-transfer medium comprising a 50%–50% methane-ethane binary mixture. The data in the Table were obtained using a commercially available process simulation program called HYSYS™. However, other commercially available process simulation programs can be used to develop the data, including for example HYSIM™, PROII™, and ASPEN PLUS™, which are familiar to persons skilled in the art. The data presented in the Table are offered to provide a better understanding of the present invention, but the invention is not to be construed as necessarily limited thereto. The temperatures and flow rates are not to be considered as limitations upon the invention which can have many variations in temperatures and flow rates in view of the teachings herein.

TABLE

| | Phase Vapor | Pressure | | Temperature | | Total Flow | |
|---|---|---|---|---|---|---|---|
| Stream | Liquid | kPa | psia | ° C. | ° F. | kgmole/hr | MMSCF* |
| 10 | L | 115 | 17 | −160 | −256 | 37,520 | 753 |
| 12 | L | 115 | 17 | −160 | −256 | 37,520 | 753 |
| 14 | L | 2,758 | 400 | −159 | −254 | 37,520 | 753 |
| 16 | L | 2,758 | 400 | −98 | −144 | 37,520 | 753 |
| 17 | L | 260 | 38 | −139 | −218 | 18,520 | 372 |
| 19 | L | 2,000 | 38 | −138 | −216 | 18,520 | 372 |
| 20 | V/L | 2,000 | 290 | −71 | −96 | 18,520 | 372 |
| 23 | V | 2,000 | 290 | 24 | 75 | 18,520 | 372 |
| 25 | V | 260 | 36 | −71 | −96 | 18,520 | 372 |

*Million standard cubic feet per day

A person skilled in the art, particularly one having the benefit of the teachings of this patent, will recognize many modifications and variations to the specific process disclosed above. As discussed above, the specifically disclosed embodiments and examples should not be used to limit or restrict the scope of the invention, which is to be determined by the claims below and their equivalents.

What is claimed is:

1. A process for recovering power, comprising the steps of:

(a) pumping liquefied natural gas from a pressure at or near atmospheric pressure to a pressure above 1379 kPa (200 psia) and below the critical pressure of the natural gas;

(b) passing the pressurized liquefied natural gas through a first heat exchanger whereby the pressurized liquefied natural gas is heated to a temperature above −112° C.(−170° F.) and the liquefied natural gas continuing to be at or below its bubble point; and (c) circulating a refrigerant as a working fluid in a closed circuit through the first heat exchanger to condense the refrigerant and to provide heat for warming the liquefied gas, through a pump to pressurize the condensed refrigerant, through a second heat exchanger in which heat is absorbed from a heat source to vaporize the pressurized refrigerant, and through a gas turbine to produce energy.

2. The process of claim 1 wherein the heat source for the second heat exchanger is water.

3. The process of claim 1 wherein the heat source for the second heat exchanger is a warm fluid selected from the group consisting essentially of air, ground water, sea water, river water, waste hot water and steam.

4. The process of claim 1 wherein the refrigerant comprises a mixture of methane and ethane.

5. The process of claim 1 wherein the refrigerant comprises a mixture of hydrocarbons having 1 to 6 carbon atoms per molecule.

6. The process of claim 1 wherein an electric generator is coupled to the work-producing device to generate electricity.

7. The process of claim 1 further comprising the step of using at least a portion of the energy produced in step (c) to provide energy for the pumping of step (a).

* * * * *

UNITED STATES PATENT AND TRADEMARK OFFICE

CERTIFICATE OF CORRECTION

PATENT NO. : 6,116,031
APPLICATION NO. : 09/277071
DATED : September 12, 2000
INVENTOR(S) : Moses Minta and Ronald R. Bowen It is certified that error appears in the above-identified patent and that said Letters Patent is hereby corrected as shown below:

Title page showing illustrative Fig. should be deleted and replaced with attached title page Replace drawing with the attached.

Signed and Sealed this

Thirty-first Day of July, 2007

JON W. DUDAS
*Director of the United States Patent and Trademark Office*

United States Patent [19]

Minta et al.

[11] Patent Number: 6,116,031

[45] Date of Patent: Sep. 12, 2000

[54] PRODUCING POWER FROM LIQUEFIED NATURAL GAS

[75] Inventors: Moses Minta, Sugar Land; Ronald R. Bowen, Magnolia, both of Tex.

[73] Assignee: ExxonMobil Upstream Research Company, Houston, Tex.

[21] Appl. No.: 09/277,071

[22] Filed: Mar. 26, 1999

Related U.S. Application Data

[60] Provisional application No. 60/079,642, Mar. 27, 1998.

[51] Int. Cl.[7] ..... F17C 9/02

[52] U.S. Cl. ..... 62/50.2

[58] Field of Search ..... 62/50.2, 614

[56] References Cited

U.S. PATENT DOCUMENTS

| | | | |
|---|---|---|---|
| 2,975,607 | 3/1961 | Bodle | 62/52 |
| 3,068,659 | 12/1962 | Marshall, Jr. | 62/52 |
| 3,183,666 | 5/1965 | Jackson | 60/38 |
| 3,203,191 | 8/1965 | French | 62/9 |
| 3,405,530 | 10/1968 | Denahan et al. | 62/28 |
| 3,425,548 | 2/1969 | Pitaro | 62/53 |
| 3,479,832 | 11/1969 | Sarsten et al. | 62/52 |
| 3,978,663 | 9/1976 | Mandrin et al. | 60/39.67 |
| 3,992,891 | 11/1976 | Poernjo | 62/53 |
| 4,030,301 | 6/1977 | Anderson | 60/641 |
| 4,320,303 | 3/1982 | Ooka et al. | 290/1 R |
| 4,400,947 | 8/1983 | Ruhemann | 60/648 |
| 4,429,536 | 2/1984 | Nozawa | 60/655 |
| 4,437,312 | 3/1984 | Newton et al. | 60/648 |
| 4,444,015 | 4/1984 | Matsumoto et al. | 60/648 |
| 4,479,350 | 10/1984 | Newton et al. | 60/655 |
| 5,440,588 | 8/1995 | Yamane et al. | 60/39.465 |
| 5,457,951 | 10/1995 | Johnson et al. | 60/39.02 |

OTHER PUBLICATIONS

L. L. Johnson and G. Renaudin, 'Liquid turbines' improve LNG Operations: Oil and Gas Journal, Nov. 1996, pp. 31–32 and 35–36.

H. Kashimura, et al., Power generator using cold potential of LNG in multicomponent fluid rankine cycle, Seventh International Conference on Liquefied Natural Gas, May 15–19, 1983, pp. 2–14.

S. H. Chansky and J. E. Haley, How to use the cold in LNG, The Magazine of Gas Distribution, Aug. 1968, pp. 42–47.

*Primary Examiner*—William Doerrler
*Assistant Examiner*—Malik N. Drake
*Attorney, Agent, or Firm*—Gary D. Lawson

[57] ABSTRACT

A process is disclosed for converting liquefied natural gas (LNG), at a temperature of about −162° C. (−260° F.) and a pressure near atmospheric pressure, to a pressurized liquefied natural gas (PLNG) having a temperature above −112° C. (−170° F.) and a pressure sufficient for the liquid to be at or near its bubble point and at the same time producing energy derived from the cold of the LNG. The LNG is pumped to a pressure above 1,380 kPa (200 psia) and passed through a heat exchanger. A refrigerant as a working fluid in a closed circuit is passed through the heat exchanger to condense the refrigerant and to provide heat for warming the pressurized LNG. The refrigerant is then pressurized, vaporized by an external heat source, and then passed through a work-producing device to generate energy.

7 Claims, 1 Drawing Sheet

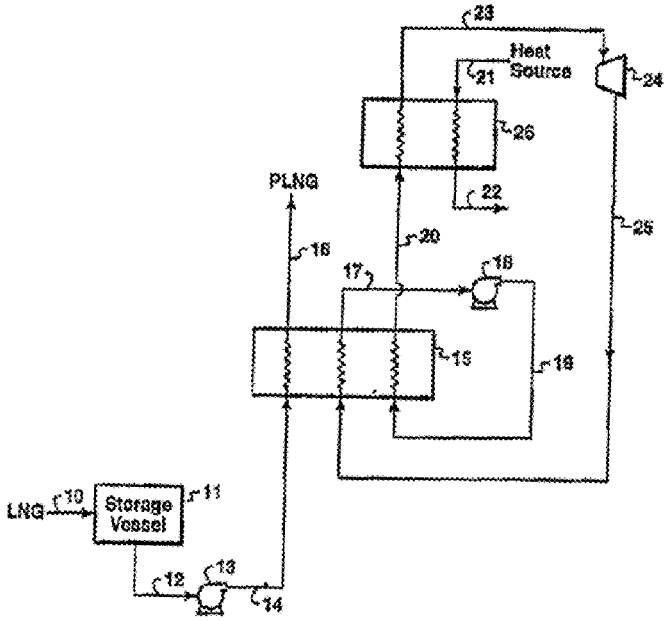

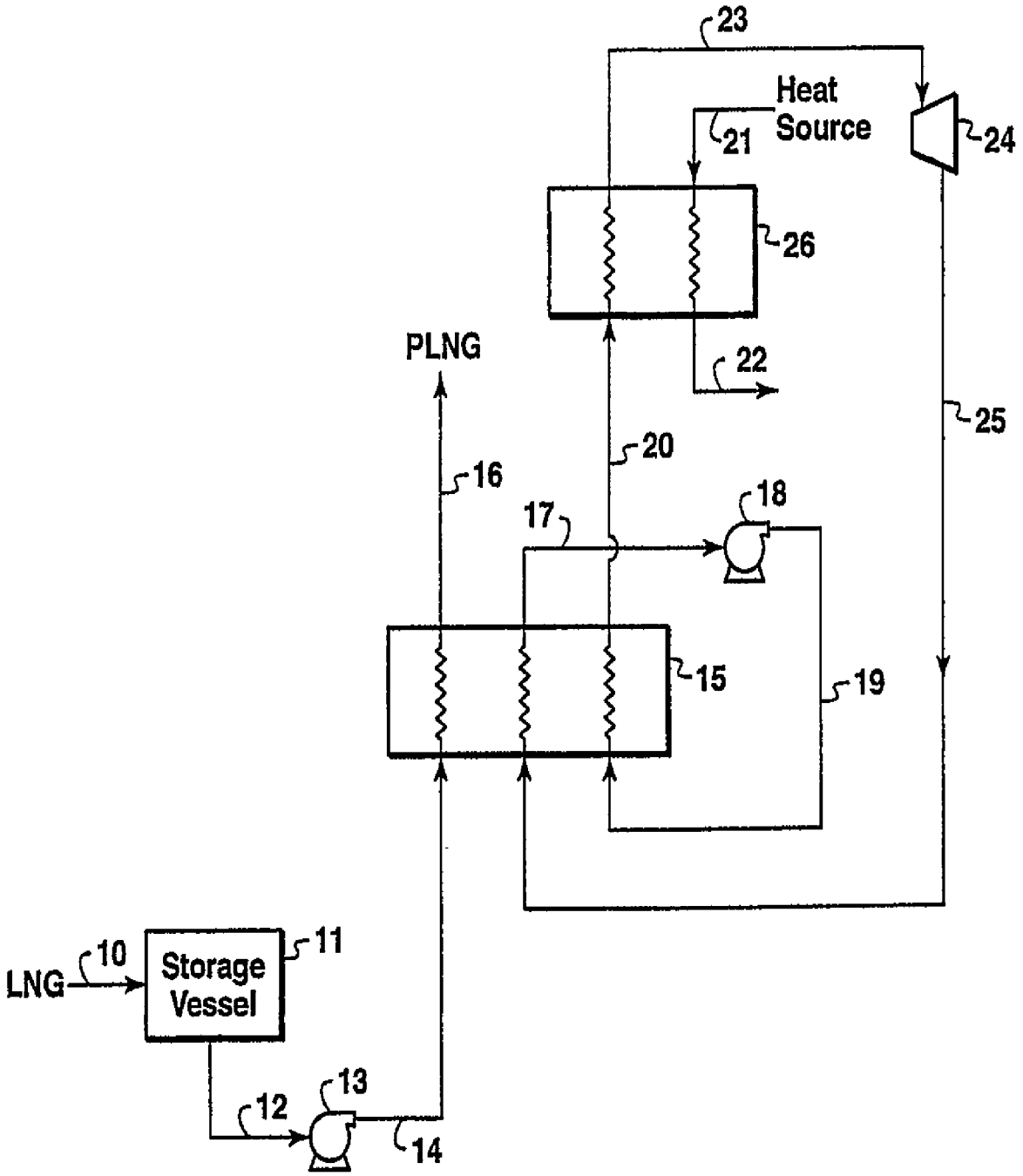
23
Heat
Source
21
24
26
PLNG
22
25
20
16
18
17
15
19
LNG
10
Storage
Vessel
11
13
12
14